US008499549B2

(12) United States Patent
Herges

(10) Patent No.: US 8,499,549 B2
(45) Date of Patent: Aug. 6, 2013

(54) EXHAUST GAS CONTROL SYSTEM AND EXHAUST GAS CONTROL METHOD

(75) Inventor: Michael Herges, Munich (DE)

(73) Assignee: KNORR-BREMSE Systeme fuer Nutzfahrzeuge GmbH, Munich (DE)

( * ) Notice: Subject to any disclaimer, the term of this patent is extended or adjusted under 35 U.S.C. 154(b) by 0 days.

(21) Appl. No.: 12/851,972

(22) Filed: Aug. 6, 2010

(65) Prior Publication Data

US 2011/0030342 A1 Feb. 10, 2011

Related U.S. Application Data

(63) Continuation of application No. PCT/EP2009/001254, filed on Feb. 20, 2009.

(30) Foreign Application Priority Data

Feb. 22, 2008 (DE) ..... 10 2008 010 658

(51) Int. Cl.
*F01N 3/00* (2006.01)

(52) U.S. Cl.
USPC ..... 60/292; 60/274; 60/311; 60/324; 123/323; 137/115.01; 137/115.13; 137/115.18

(58) Field of Classification Search
USPC ..... 60/274, 287, 291, 292, 293, 311, 60/324; 123/323; 137/115.01, 115.12, 115.13, 137/115.18
See application file for complete search history.

(56) References Cited

U.S. PATENT DOCUMENTS

| | | | | |
|---|---|---|---|---|
| 4,677,823 | A * | 7/1987 | Hardy | 60/274 |
| 4,750,459 | A | 6/1988 | Schmidt | |
| 4,835,963 | A | 6/1989 | Hardy | |
| 5,355,673 | A | 10/1994 | Sterling et al. | |
| 5,394,901 | A | 3/1995 | Thompson et al. | |
| 5,489,319 | A * | 2/1996 | Tokuda et al. | 96/400 |
| 5,723,829 | A * | 3/1998 | Inomata et al. | 181/254 |
| 5,836,152 | A * | 11/1998 | Schatz | 60/274 |
| 6,109,027 | A * | 8/2000 | Schaefer | 60/324 |
| 6,179,096 | B1 * | 1/2001 | Kinerson et al. | 188/154 |
| 6,729,123 | B2 * | 5/2004 | Tamura et al. | 60/285 |
| 7,337,609 | B2 * | 3/2008 | Mahnken et al. | 60/297 |
| 2007/0261395 | A1 | 11/2007 | Mahnken et al. | |

FOREIGN PATENT DOCUMENTS

| | | | |
|---|---|---|---|
| DE | 1 808 949 | U | 3/1960 |
| DE | 26 25 095 | C2 | 12/1977 |
| DE | 44 16 739 | A1 | 11/1995 |
| DE | 691 22 880 | T2 | 4/1997 |
| DE | 198 21 130 | A1 | 11/1998 |

(Continued)

OTHER PUBLICATIONS

German Office Action dated Sep. 2, 2008 including English-language translation (Eight (8) pages).

(Continued)

*Primary Examiner* — Binh Q Tran
(74) *Attorney, Agent, or Firm* — Crowell & Moring LLP

(57) ABSTRACT

An exhaust gas control system and an exhaust gas control method are provided. The exhaust gas control system includes an exhaust gas throttle valve in an exhaust gas duct and an actuation device of the exhaust gas throttle valve having an actuating rod. An exhaust gas pressure control device controls the exhaust gas pressure occurring upstream of the exhaust gas throttle valve in the exhaust gas duct. The actuating rod also includes a control actuator that interacts with a pressure compensation volume. The pressure compensation volume is pneumatically connected to a throttle opening upstream of the exhaust gas throttle valve.

33 Claims, 9 Drawing Sheets

FOREIGN PATENT DOCUMENTS

| | | | |
|---|---|---|---|
| DE | 198 38 032 | A1 | 3/1999 |
| FR | 1.231.337 | A | 9/1960 |
| WO | WO 99/25962 | A1 | 5/1999 |
| WO | WO 01/33049 | A1 | 5/2001 |

OTHER PUBLICATIONS

German Office Action dated Nov. 25, 2008 including English-language translation (Six (6) pages).
Notice of telephone conference with German Examiner dated Oct. 13, 2009 including English-translation (Three (3) pages).
Summary of Oral Hearing with Examiner dated Dec. 1, 2009 including English-language translation (Six (6) pages).
International Search Report dated Jun. 3, 2009 including English-language translation (Four (4) pages).

* cited by examiner

EXHAUST GAS CONTROL SYSTEM AND EXHAUST GAS CONTROL METHOD

CROSS-REFERENCE TO RELATED APPLICATIONS

This application is a continuation of PCT International Application No. PCT/EP2009/001254, filed Feb. 20, 2009, which claims priority under 35 U.S.C. §119 from German Patent Application No. DE 10 2008 010658.5, filed Feb. 22, 2008, the entire disclosures of which are herein expressly incorporated by reference.

BACKGROUND AND SUMMARY OF THE INVENTION

The invention relates to an exhaust gas control system and to an exhaust gas control method. The exhaust gas control system has an exhaust gas throttle valve in an exhaust gas duct and an actuation device for the exhaust gas throttle valve. The actuation device has an actuating linkage. An exhaust gas pressure control device controls the exhaust gas pressure occurring in the exhaust gas duct upstream of the exhaust gas throttle valve. An exhaust gas control system of this kind with an exhaust gas throttle valve has many applications in internal combustion engines, preferably in internal combustion engines of motor vehicles.

The fact that an exhaust gas control system of this kind can be used as an exhaust brake is known from printed publication DE 198 21 130A1. In this case, the flow of exhaust gases from the internal combustion engine is prevented by an exhaust brake flap in order to achieve an increase in the power of the engine brake. For this purpose, the exhaust tract is sealed as tightly as possible, and the injection pump is simultaneously switched to zero delivery. In this state, the engine is driven by the overrunning motor vehicle, and the pressure rises owing to the compressor action of the engine.

Unless an exhaust gas control system is provided, a rise in the pressure upstream of the exhaust brake flap can have the effect that cylinder valves of the engine are disadvantageously forced open and exhaust gas flows back into other cylinders. Another risk associated with a solution of this kind involving an exhaust brake flap to assist engine braking performance is that, after additional cylinder valves have been forced open, an increased amount of gas is pumped backward and forward between the exhaust gas duct and the individual cylinders, with the result that a large amount of heat is generated, causing the temperature upstream of the exhaust brake flap to rise.

In order to limit the rise in pressure and temperature, DE 198 21 130 discloses an exhaust gas control system 50 of the type shown in FIG. 7, with an exhaust brake flap or throttle flap 12. In order to achieve pressure and temperature limitation, the throttle flap 12 has a pressure limiting valve 35 arranged on the throttle flap 12. When closed, the pressure limiting valve 35 keeps an opening 37 in the throttle flap 12 closed under a preload by means of a valve flap 36. The preload is applied by a leaf spring 38, as FIG. 7 shows. The valve flap 36 of the pressure limiting valve 35 opens as soon as a permissible exhaust gas pressure $P_1$ upstream of the throttle flap 12 is exceeded and hence also as soon as an impermissibly high temperature $T_1$ in the exhaust gas duct 5 would arise. By means of the pressure limiting valve 35, the engine is thus protected from excess pressure and excess temperature in a braking phase.

A dynamic pressure-limiting exhaust gas control system 40, which is shown in FIG. 8, is known from U.S. Pat. No. 4,750,459. For this purpose, the exhaust gas control system 40 has a butterfly throttle flap 13. When closed, an edge surface of the butterfly throttle flap 13 is sealed off in a zone 41 by a valve head 42 of a pressure relief valve 43. When a permissible upstream exhaust gas pressure $P_1$ is exceeded, the pressure relief valve 43 opens a bypass, via which an excess pressure and hence also an excessive increase in temperature can be reduced.

An exhaust gas control system 60 of the type shown in FIG. 9, which operates with an asymmetrically arranged throttle flap 12, is furthermore known from U.S. Pat. No. 5,355,673. Here, the throttle flap 12 can be pivoted about a pivot 28 arranged outside the axis of symmetry of the exhaust gas duct 5. In a closed state of the asymmetrically mounted throttle flap 12, which can be held in the closed state by means of a spring element, the spring elastic preload is overcome when there is an excess pressure upstream of the throttle flap, and the preloaded throttle flap 12 opens a gap, via which the excess pressure and hence an excess temperature upstream of the throttle flap 12 can be reduced.

By virtue of the known exhaust gas control systems, it is thus impossible to exceed a maximum permissible pressure at a maximum engine speed. With these solutions, the backpressure of the engine exerts an opening force which overcomes the closing spring mechanism in the known solutions. However, this has the disadvantage that either the throttle flap itself or at least the limiting valve vibrates or flutters continuously owing to the pulsating pressure in the exhaust gas duct since the engine does not discharge the gas in a constant stream but rather in phases in accordance with the piston strokes. This means that exhaust gas control systems of this kind are subject to severe wear and a short service life, and it can additionally lead to severe noise generation.

It is the object of the invention to overcome the disadvantages of the prior art and to specify an exhaust gas control system which not only uses the rise in pressure upstream of a closed exhaust gas throttle flap for an exhaust flap brake but also uses to advantage the rise in temperature, associated with the rise in pressure, in the exhaust gas duct upstream of an exhaust gas throttle valve.

This object is achieved according to the invention by an exhaust gas control system and an exhaust gas control method, wherein the exhaust gas control system has an exhaust gas throttle valve in an exhaust gas duct and an actuation device for the exhaust gas throttle valve. The actuation device has an actuating linkage. An exhaust gas pressure control device controls the exhaust gas pressure occurring in the exhaust gas duct upstream of the exhaust gas throttle valve. For this purpose, the actuating linkage has a control actuator which interacts with a pressure compensation volume. In this arrangement, the pressure compensation volume is connected pneumatically to a restrictor opening upstream of the exhaust gas throttle valve.

One advantage of this exhaust gas control system is that the pressure upstream of the exhaust gas throttle valve is introduced into a compensation volume via the restrictor opening and is passed from said volume to an actuator which, as a function of the pressure directly applied to the actuator, can transfer the exhaust gas throttle valve stably from a closed position to a position controlled as a function of pressure by way of the linkage. The restrictor opening in conjunction with the compensation volume gives rise to a delay element which to a large extent filters high-frequency pressure peaks out of the pulsating exhaust gas pressure in an advantageous manner. By adaptation of the exhaust gas throttle valve and of the output volume, it is possible to set the filter behavior of this delay element so that both high-frequency fluttering of the exhaust gas throttle valve and excess pressure over a prolonged period can be avoided with the exhaust gas control system according to the invention. The compensation volume gives rise to a somewhat slow mean pressure rise, but this does not lead to additional cylinder valves being forced open since the control actuator in the actuating linkage enables the exhaust gas pressure, and an exhaust gas temperature determined by the exhaust gas pressure, to be controlled upstream of the exhaust gas throttle valve.

At the same time, the exhaust gas pressure control device preferably has an exhaust gas pressure limiting device, which makes it possible to limit the exhaust gas pressure upstream of the exhaust gas throttle valve.

For pressure control or pressure limitation, the exhaust gas throttle valve can have a throttle flap, which interacts via a pivot with the actuating linkage and hence also with the control actuator. Instead of a throttle flap, the exhaust gas throttle valve preferably has a butterfly throttle flap which is of completely symmetrical configuration with respect to a pivoting axis, the pivoting axis coinciding with an axis of symmetry of the exhaust gas duct in the region of the throttle valve. A butterfly throttle flap of this kind has the advantage that the required adjustment forces at the throttle flap axis are minimal.

In a preferred embodiment of the invention, the actuation device has a drive which assumes two end positions, with a first end position, in which the actuating linkage and the control actuator hold the exhaust gas throttle valve in an open position. In a second end position of the drive, the control actuator comes into effect, and the exhaust gas throttle valve is held in a position determined by the exhaust gas pressure of the pressure compensation volume. Owing to the evened out pressure in the compensation volume, this position is completely stable and hence fluttering of a throttle flap, in particular a butterfly throttle flap, does not occur.

In order to achieve the two end positions of the drive, the drive can have an electromagnetically operated piston. Solenoid drives of this kind have the advantage that they can move relatively rapidly between the two end positions of the linkage.

In another embodiment of the invention, the drive has a hydraulically operated piston, a drive of this kind allows the two end positions to be assumed in a damped manner.

In another embodiment of the invention, the drive has a pneumatically operated piston, it being possible for a pneumatic drive of this kind to be varied in an advantageous manner in its motion sequence for the linkage.

In this arrangement, the control actuator is connected mechanically to the piston of the drive. This mechanical connection includes both direct fixing of the control actuator on the piston and transfer of the motion of the drive to the control actuator via a corresponding connecting rod. Here, a relatively large control range for the exhaust gas pressure-determined position of the exhaust gas throttle valve can be associated with direct fixing of the actuator on the piston, while the pressure-dependent deflection of the linkage can be reduced correspondingly with the aid of a connecting rod.

For a hydraulic or pneumatic drive, provision is made for the actuation device to have an operating cylinder, a piston and a connecting rod, which is preloaded in a spring-elastic manner in a first, inactive state of the operating cylinder. Here, the operating cylinder is fixed in an articulated manner at an end situated opposite the connecting rod. This articulated fixing can advantageously compensate for a circular motion of a lever arm about the pivot of the exhaust gas throttle valve as the exhaust gas throttle valve is moved from an open position into a closed position and vice versa if both the stroke motion of the connecting rod and the stroke motion of the control actuator take place in a straight line and are connected to the lever arm via a joint.

The control actuator can be of similar construction to the drive with a drive piston. For this purpose, the control actuator preferably has an actuator cylinder with an actuator piston preloaded in a spring-elastic manner and an actuator rod fixed on the actuator piston. The free end of the actuator rod is pivotally attached to a lever arm which interacts with a pivot of the exhaust gas throttle valve. In this arrangement, the control actuator comes into effect only when the exhaust gas throttle valve is in a closed position and an excess pressure and an excess temperature dependent on the pressure builds up in the exhaust gas duct upstream of the exhaust gas throttle valve. Only then is the pressure compensation volume charged via the restrictor opening upstream of the exhaust gas throttle valve and can set in motion the actuator or actuator piston if an impermissibly high maximum pressure, at which there is a risk that additional cylinder valves will be forced open, builds up.

In order to allow interaction between the pressure compensation volume and the actuator cylinder, the actuator cylinder has an opening which is connected pneumatically to the pressure compensation volume. In a reduced-pressure state of the pressure compensation volume, the lever arm, which is pivotally attached to the actuator rod, has a maximum deflection and, in a pressurized state of the pressure compensation volume, the lever arm has a deflection controlled as a function of pressure.

Here, the length of the actuating linkage, which is made up of the connecting rod of the drive and the actuator rod of the control actuator, is in practice shortened. As already mentioned above, if there is a requirement for a larger deflection of the linkage, the actuator cylinder can be mounted directly on the drive piston, something that may preferably be advantageous for cleaning a diesel particle filter (DPF) in order to allow greater temperature variation upstream of the exhaust gas control valve with the engine running and fuel injection switched on.

In a preferred embodiment of the invention, a pressure compensation volume container is arranged at the restrictor opening of the exhaust gas duct upstream of the exhaust gas throttle valve. The pressure compensation volume container is connected to the opening of the actuator cylinder via a pressure line. In this arrangement, the pressure line is of a flexible design to enable it to follow the movements of the actuating linkage and hence the movements of the actuator cylinder.

In another preferred embodiment of the invention, the pressure compensation volume and the control actuator are arranged in a common container. This has the advantage that the number of components of the exhaust gas control system can be reduced, and this is advantageous for storage costs, spare parts costs and assembly costs.

Provision is furthermore made to design the connecting rod as a hollow cylinder, with the hollow cylinder having the control actuator. A hollow cylinder of this kind is thus seated directly on the drive piston of the drive, and the length of the hollow cylinder therefore determines the possible maximum actuator stroke at the lever arm for actuating the exhaust gas throttle system. Moreover, the hollow cylinder designed as a connecting rod can form a common housing for both the control actuator and the pressure compensation volume. In this case, the number of components that have to be provided for the exhaust gas control system is further reduced since not only is the connecting rod eliminated but the hollow cylinder can also simultaneously form the piston for the drive in the drive cylinder.

Moreover, provision is made for the exhaust gas throttle valve to be arranged downstream of an exhaust manifold of an internal combustion engine and upstream of a DPF. In this case, the exhaust gas throttle valve in conjunction with the exhaust gas control system serves as an exhaust throttle flap brake, which can be activated when fuel injection into the engine is switched off. On the other hand, the exhaust gas throttle valve can be arranged downstream of a DPF of an internal combustion engine and upstream of an exhaust muffler. In this case, the increase in the exhaust gas temperature associated with the rise in pressure in the exhaust gas duct can be used, for example, to clean the DPF by heating it up, while the injection process or injection of fuel into the engine is not switched off.

Such cleaning can take place both periodically while the vehicle is being driven and while the vehicle is stationary with the engine running. Since the engine does not operate as a compressor in this case but, on the contrary, supplies hot exhaust gases, a larger pressure-dependent deflection of the control actuator is helpful, as allowed by one of the embodiments of the invention described below, in order to be able to carry out an optimum temperature cycle for the cleaning of the DPF, e.g. while the vehicle is being driven.

An exhaust gas control method involving an exhaust gas control system has the following method steps. First of all, an exhaust gas throttle valve is provided in an exhaust gas duct, being adjustable by way of an actuating linkage of an actuation device. An exhaust gas pressure control device for the pulsating exhaust gas pressure occurring in the exhaust gas duct upstream of the exhaust gas throttle valve is furthermore provided. Additionally provided upstream of the exhaust gas throttle valve is a restrictor opening, which feeds the pulsating exhaust gas pressure to a pressure compensation volume which compensates for pressure peaks in the pulsating exhaust gas pressure and feeds the compensated exhaust gas pressure to a control actuator.

In a first end position of a drive, an actuating linkage with the control actuator holds the exhaust gas throttle valve stably in an open position. In a second end position of the drive, the actuating linkage with the control actuator holds the exhaust gas throttle valve in a stable position controlled by the applied pressure in the pressure compensation volume. An exhaust gas control method of this kind can be used in an advantageous manner both for an exhaust flap brake and for cleaning and regeneration processes in a DPF.

In this exhaust gas control method, in a closed position of the exhaust gas throttle flap, the pressure upstream of an exhaust gas throttle flap is fed to the pressure compensation volume via a restrictor opening, and the compensated exhaust gas pressure is supplied to an actuator, which opens the exhaust gas throttle flap in a manner controlled as a function of the compensated exhaust gas pressure. Here, the restrictor opening and the pressure compensation volume form a delay element with a filter effect, in which pressure peaks in the pulsating exhaust gas pressure are reduced or filtered out, with the filtering behavior being set so that the exhaust gas throttle flap can assume a stable position controlled as a function of pressure.

In this exhaust gas control method, a first open position is maintained by the exhaust gas throttle valve for as long as a drive of an actuation device is inactive and maintains a first end position. As soon as the drive of the actuation device is activated and assumes a second end position, in which the control actuator is in a setting controlled by the pressure of the pressure compensation volume, the exhaust gas throttle valve is accordingly transferred from a closed position to a pressure-dependent second controlled stable position.

Here, the drive can drive a piston in an operating cylinder electromagnetically, hydraulically or pneumatically and move it from a first end position to a second end position.

In a preferred implementation of the method, a lever arm, which interacts with a pivot of the exhaust gas throttle valve and is pivotally attached to a free end of an actuator rod, is moved as a function of pressure by an actuator piston of an actuator cylinder. For this purpose, the actuator cylinder is connected pneumatically to the pressure compensation volume via an opening. In a reduced-pressure state of the pressure compensation volume, the lever arm, which is pivotally attached to the actuator rod, assumes a maximum deflection and, in a pressurized state of the pressure compensation volume, the control actuator imparts to the lever arm a deflection controlled as a function of pressure.

The exhaust gas control method can be employed to boost engine braking if the exhaust gas throttle valve is arranged downstream of an exhaust manifold of an internal combustion engine and upstream of a soot particle filter of an engine system, and the pressure in the exhaust manifold is controlled in such a way by use of the exhaust gas throttle valve that a maximum permissible pressure in the internal combustion engine and a pressure-dependent maximum permissible temperature are not exceeded during a corresponding braking process with the fuel injection switched off.

It is furthermore possible to use the exhaust gas control method to heat the exhaust gas duct in order thereby to clean a DPF. For this purpose, the exhaust gas throttle valve is arranged downstream of a soot particle filter of an internal combustion engine and upstream of an exhaust muffler, and the pressure in the exhaust gas duct is controlled in such a way by use of the exhaust gas throttle valve that a maximum permissible pressure in the internal combustion engine is not exceeded and that, with fuel injection switched on, a pressure-dependent maximum permissible temperature in the DPF is not exceeded during cleaning of the DPF.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
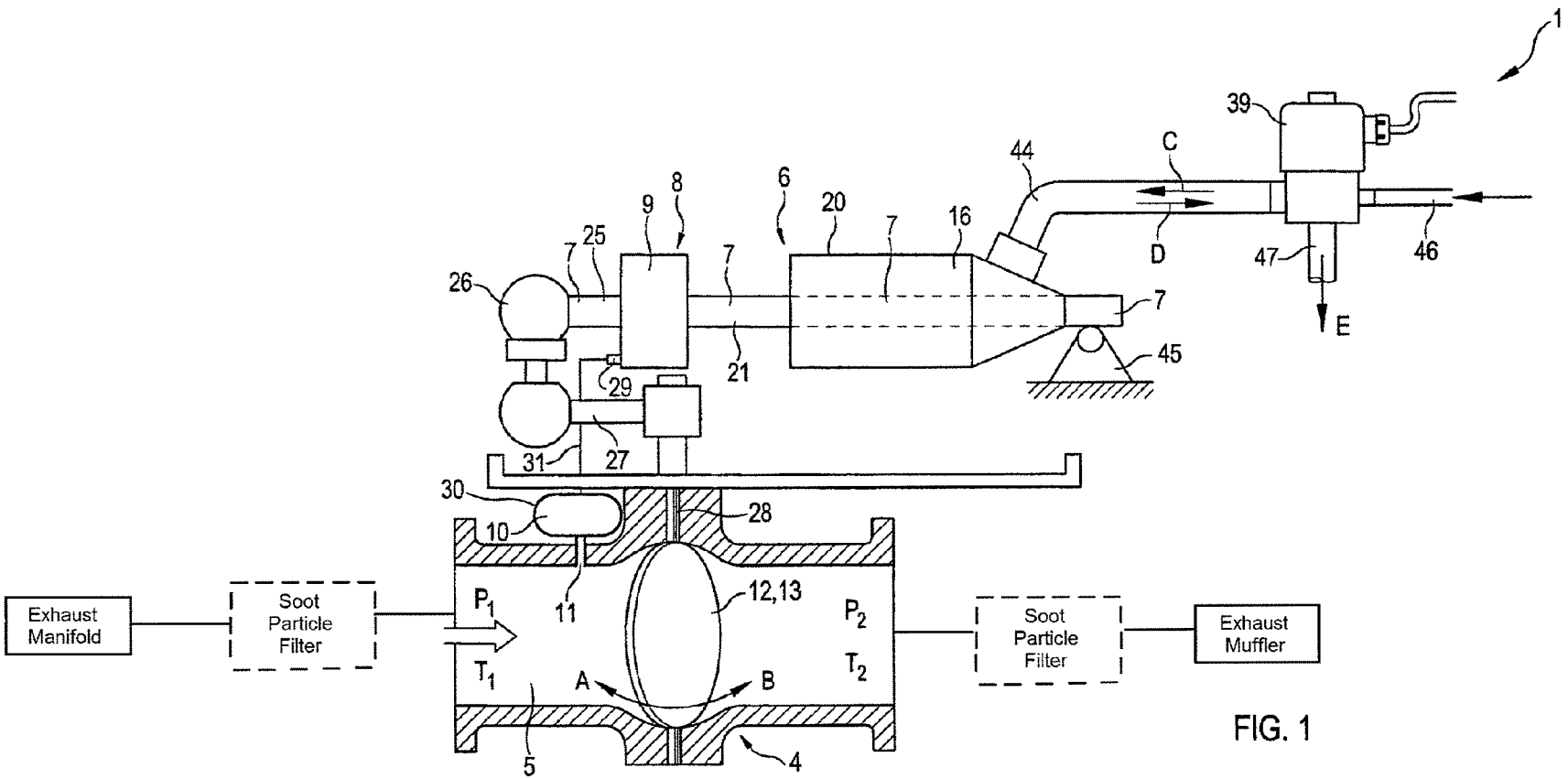
FIG. 1 shows a basic diagram of an exhaust gas control system of a first embodiment of the invention.

FIG. 1 shows a basic diagram of an exhaust gas control system 1 of a first embodiment of the invention. In an exhaust gas duct 5, the exhaust gas control system 1 has an exhaust gas throttle valve 4, which can be moved from an open position to a closed position and vice versa in the direction of arrows A and B about a pivot 28. For this purpose, a lever arm 27, which is connected in an articulated manner to a control device 8, is fixed on the pivot 28, which is passed through to the outside. The control device 8 includes a drive 16 in an operating cylinder 20, from which a connecting rod 21 projects.

The connecting rod 21 carries a control actuator 9, projecting from which is an actuator rod 25, the free end 26 of which is connected in an articulated manner to the lever arm 27 of the exhaust gas throttle valve 4. Since the lever arm 27 for adjusting the throttle flap 12, which is here designed as a butterfly throttle flap 13, performs a circular motion, the actuating linkage 7 of an actuation device 6 is supported in an articulated manner at a fixed point 45 by means of one end 22 of the operating cylinder 20 of the drive 16 (see also FIGS. 2-4).

In this embodiment of the invention, the drive 16 is supplied pneumatically with compressed air for activation in the direction of arrow C via a flexible pressure line 44. The air is fed in via a compressed air supply line 46 and via an electrically operated two-way switch 39. When the two-way switch 39 is switched off, the compressed air is discharged from the operating cylinder 20 via the pressure line 44 in the direction of arrow D and via the pressure discharge opening 47 of the two-way switch 39 in the direction of arrow E. The interaction between the drive 16 and the actuator 9 will be described in greater detail by use of the following figures.

In order to actuate the actuator 9, there is a restrictor opening 11 arranged upstream of the exhaust gas throttle valve 4. This opening supplies a pressure compensation volume 10, which is stored in a pressure compensation volume container 30 and is connected pneumatically to an opening 29 of the control actuator 9 via a pressure line 31. The portion of an exhaust gas duct 5 which is shown here can be arranged downstream of an exhaust manifold of the internal combustion engine in order to boost the braking of an internal combustion engine, or can be installed downstream of a diesel particle filter (DPF) in an existing exhaust gas duct in order to heat the DPF.

Figure 3:
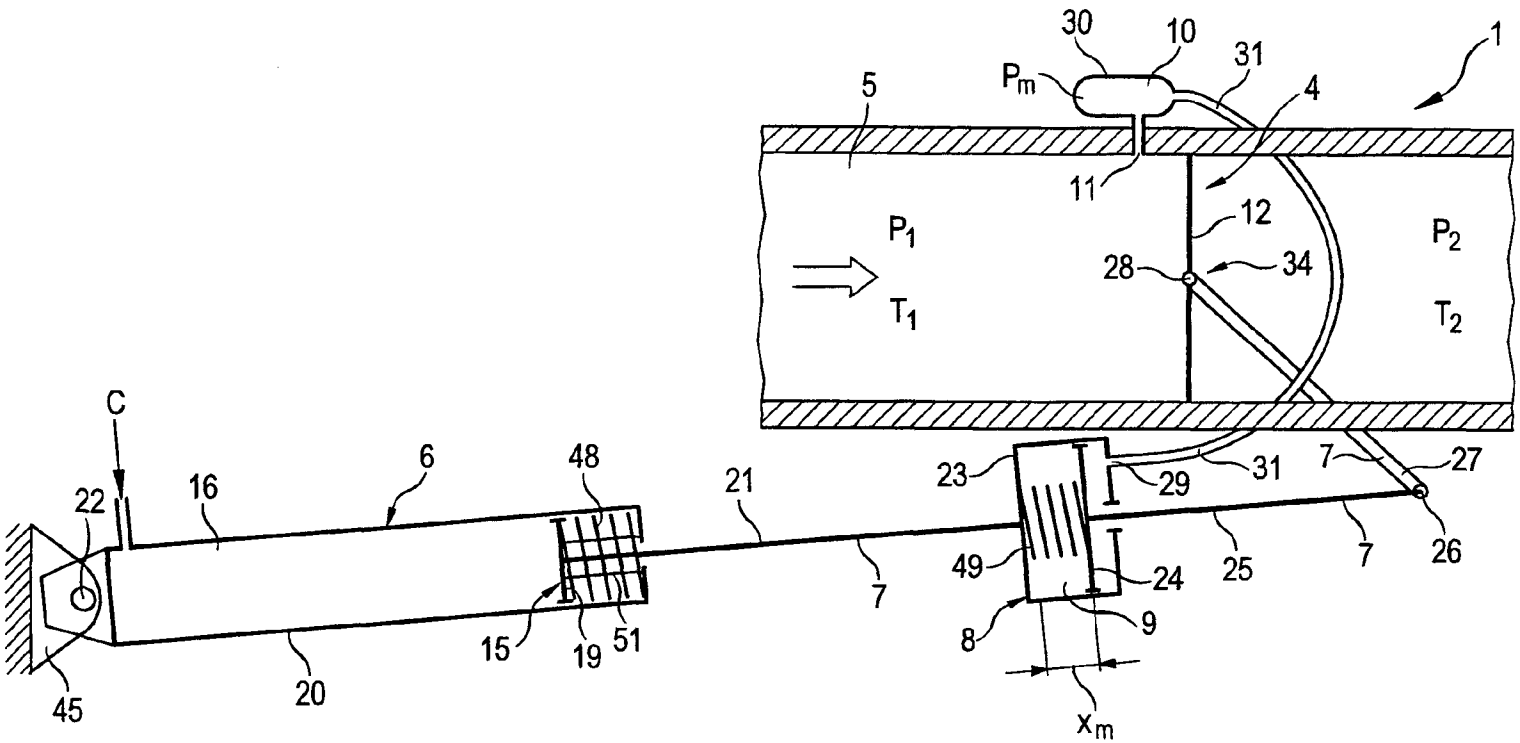
FIG. 3 shows a basic diagram of the exhaust gas control system in FIG. 1 in a second end position of the piston of the drive.

In both cases, there is an increase in the pressure and temperature to $P_1$ and $T_1$ upstream of the exhaust gas throttle valve 4 relative to a pressure $P_2$ and a temperature $T_2$ downstream of the exhaust gas throttle valve 4 when the latter assumes a closed position (see FIG. 3). In an open position of the exhaust gas throttle valve 4, the pressure difference between $P_1$ and $P_2$ should be as small as possible, for which purpose the exhaust gas throttle flap 12 is designed such that it represents a low flow resistance in the open position.

Figure 2:
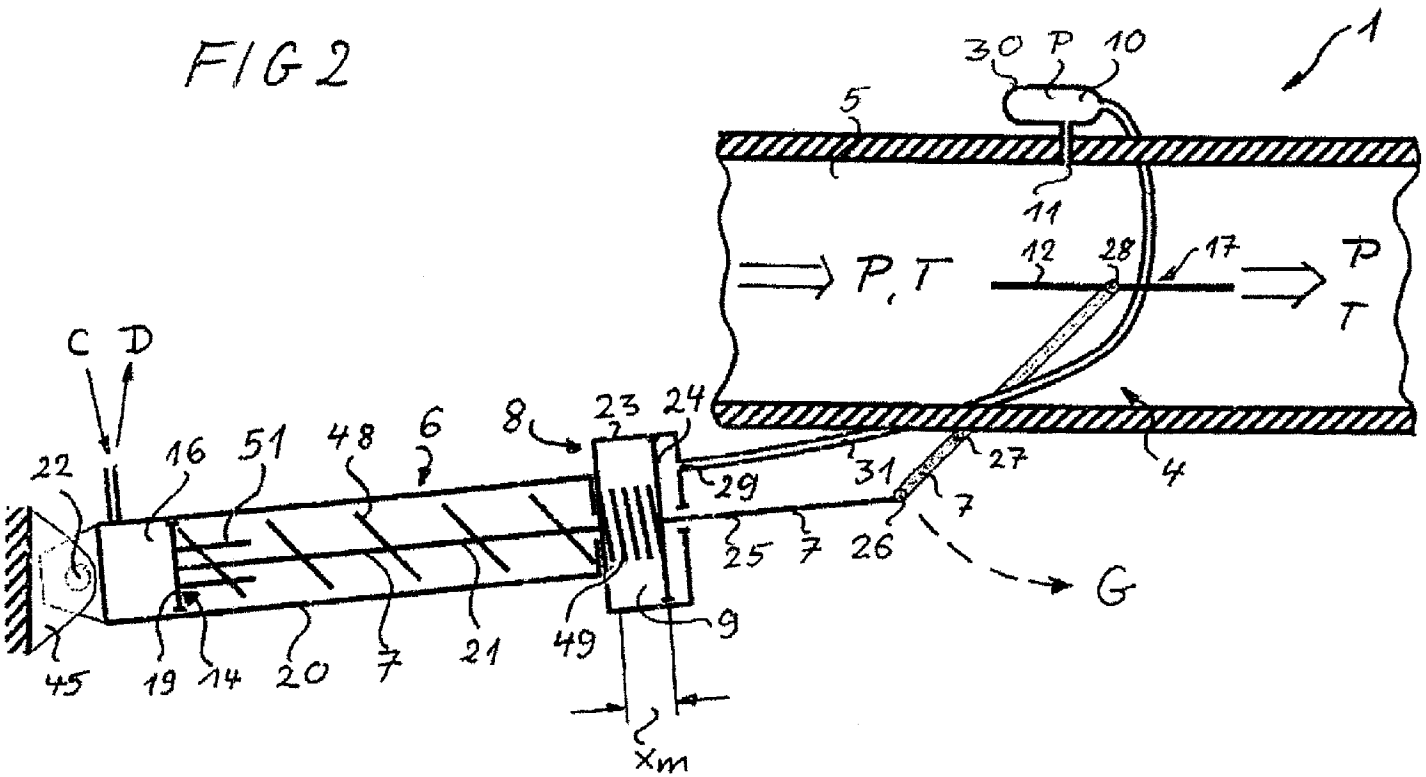
FIG. 2 shows a basic diagram of the exhaust gas control system in FIG. 1 in a first end position of a piston of a drive.

FIG. 2 shows a basic diagram of the exhaust gas control system 1 in FIG. 1 in a first end position 14 of a piston 19 of the drive 16. For this purpose, the drive 16 has the operating cylinder 20, in which the piston 19 is pushed into the first position 14 by a helical spring element 48, while the connecting rod 21, which is attached to the piston 19, is simultaneously pulled into the operating cylinder 20. To replace a helical element 48 as a return element for the piston 14, this return function can also be provided by a pressure feed line in the region of the helical element 48 shown here. This has the advantage over preloading by use of a helical spring 48 that the connecting rod 21 is not pulled abruptly into the operating cylinder but can be retracted into the operating cylinder in a controlled manner.

It is also possible for the piston 19 to be moved by an electromagnetic drive or a hydraulic drive rather than by the pneumatic drive 16 shown here. In this first embodiment of the invention, the control actuator 9 is arranged at the end of the piston rod 21. The control actuator, for its part, has an actuator cylinder 23, an actuator piston 24 and an actuator rod 25. The actuator piston 24 is held in a position of maximum deflection $x_m$ in the actuator cylinder 23 by a helical spring element 49 and, in this unactivated state of the drive 16 and of the control actuator 9, ensures, by way of the actuator rod 25, the free end 26 of which is pivotally attached to a lever arm 27, that the throttle flap 12 of the exhaust gas throttle valve 4 is held in an open position 17.

If the drive piston 19 is moved into a second end position (not shown in FIG. 2) by activation of the drive 16, the lever arm 27 follows a circular motion in the direction of arrow G, for which reason the operating cylinder 20 is arranged in an articulated manner relative to the fixed point 45 by means of its end 22 situated opposite the connecting rod 21. The pressure and the temperature in the exhaust gas duct 5 are approximately the same upstream and downstream of the throttle flap 12. At this normal exhaust gas pressure in the exhaust gas duct 5, the control actuator 9, which is connected to the compensation volume 10 in a compensation volume container 30 via the opening 29 in the actuator cylinder 23 and the pressure line 31, is not activated although the pressure compensation volume 10 is connected to the exhaust gas duct via the restrictor opening 11.

FIG. 3 shows a basic diagram of the exhaust gas control system 1 in FIG. 1 in a second end position 15 of the piston 19 of the drive 16. For this purpose, compressed air has been forced into the operating cylinder 20 in the direction of arrow C, and the helical spring element 48 has been compressed by the piston 19 as far as the second end position 15, which is defined by a stop element 51 in the operating cylinder 20. In this second end position of the piston 19, the connecting rod 21 and the actuator rod 25 ensure that the throttle flap 12 is moved into a closed position by way of the lever arm 27.

Upstream of the throttle flap 12, the pressure $P_1$ increases in the exhaust gas duct 5, but this is not constant with respect to time but acts in a pulsating manner on the closed throttle flap 12. Via a restrictor opening 11, this pulsating exhaust gas pressure is fed to the compensation volume 10, which acts like a filter and smoothes or filters out the pressure peaks in $P_1$. Thus, via the pressure line 31, a compensated pressure is forced into the actuator cylinder 23 via the opening 29 of the actuator cylinder 23. As long as a critical or maximum permissible pressure is not exceeded, the throttle flap 12 remains in this closed position 34, and the actuator piston remains in the position shown here, with a maximum deflection $x_m$ of the actuator.

Figure 4:
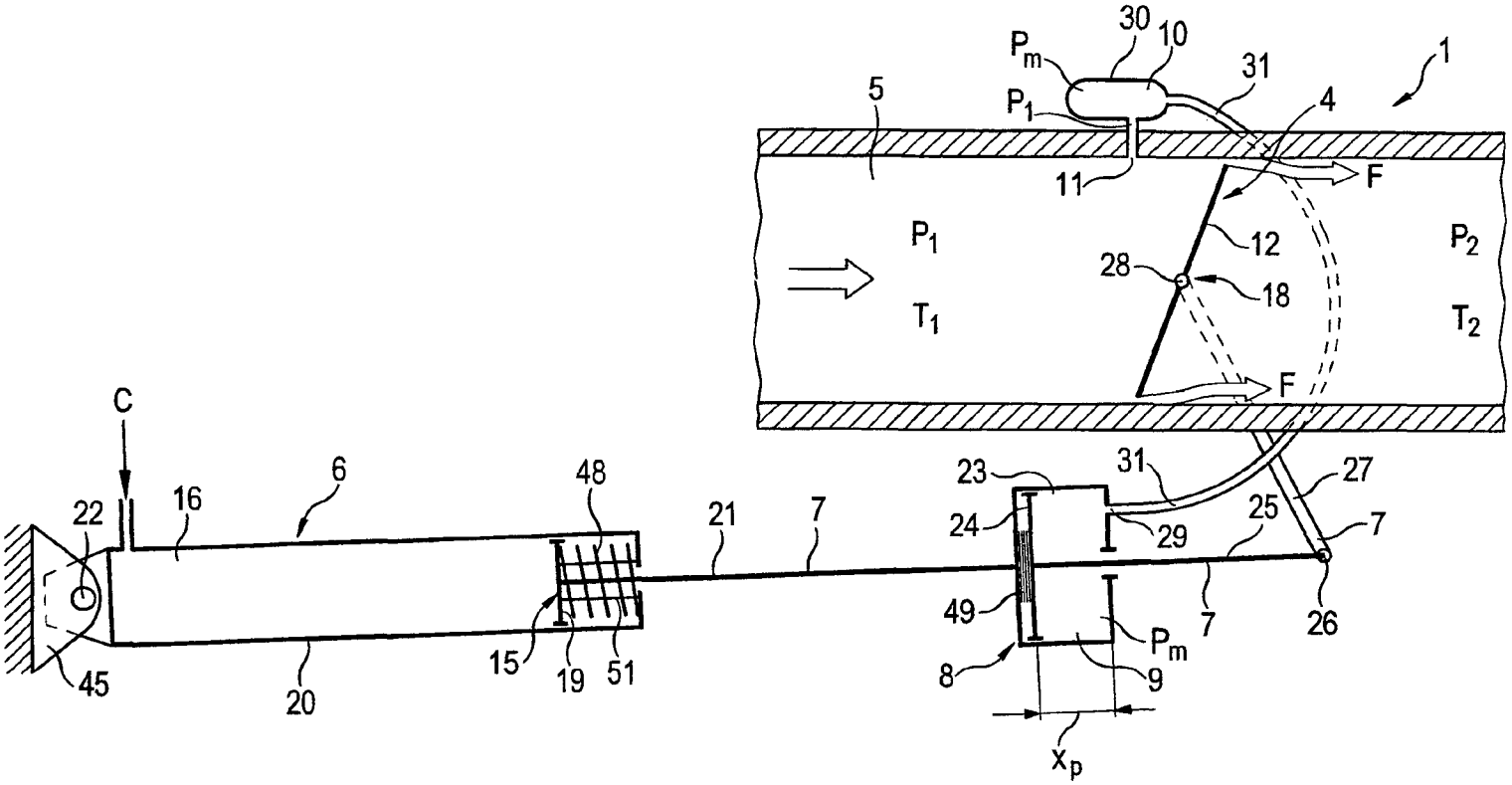
FIG. 4 shows a basic diagram of the exhaust gas control system in FIG. 1 in a second end position of the piston with the control actuator activated.

FIG. 4 shows a basic diagram of the exhaust gas control system 1 in FIG. 1 in a second end position 15 of the piston 19 with the control actuator 9 activated. If the mean pressure $P_m$ in the pressure compensation volume 10 of the pressure compensation container 30 exceeds a threshold value, the opening 29 in the actuator cylinder 23 is activated via the pressure line 31, and the actuator piston 24 undergoes a pressure-dependent deflection $x_p$, with the result that the actuator rod 25 shortens the total length of the actuating linkage 7 and hence moves the throttle flap 12 into a second pressure-dependent position 18, allowing a flow of exhaust gas in the direction of arrow F through a gap between the throttle flap 12 and the exhaust gas duct wall, thereby ensuring that the pressure $P_1$ upstream of the throttle flap 12 is held at a constant permissible level.

Figure 5:
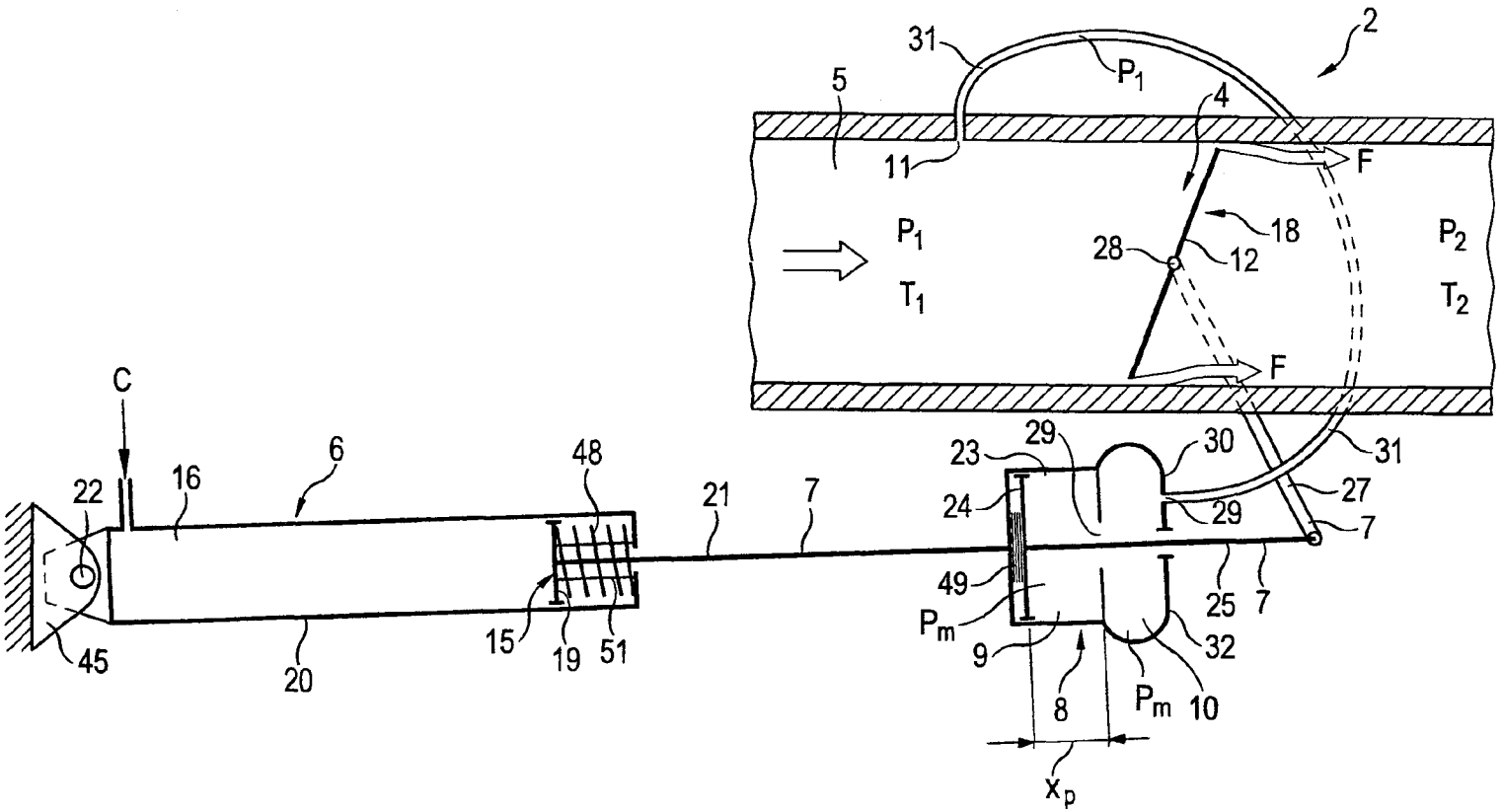
FIG. 5 shows a basic diagram of an exhaust gas control system of a second embodiment of the invention.

FIG. 5 shows a basic diagram of an exhaust gas control system 2 of a second embodiment of the invention. Components with the same functions as in the previous figures are denoted by the same reference signs and are not explained specially. In this second embodiment of the invention, only the second end position 15 of the piston 19 of the operating cylinder 20 is shown. This second embodiment differs from the first embodiment of the invention in FIGS. 1 to 4 in that the compensation volume 10 and the control actuator 9 are arranged in a common housing 32. This common housing 32 has a zone which is partially filled with the pressure compensation volume 10 and a zone in which the actuator piston 24 can be moved within the actuator cylinder 23, the two zones being coupled pneumatically to one another via an opening 29. The advantage of this embodiment has already been discussed above, and repeated explanation is therefore unnecessary.

Figure 6:
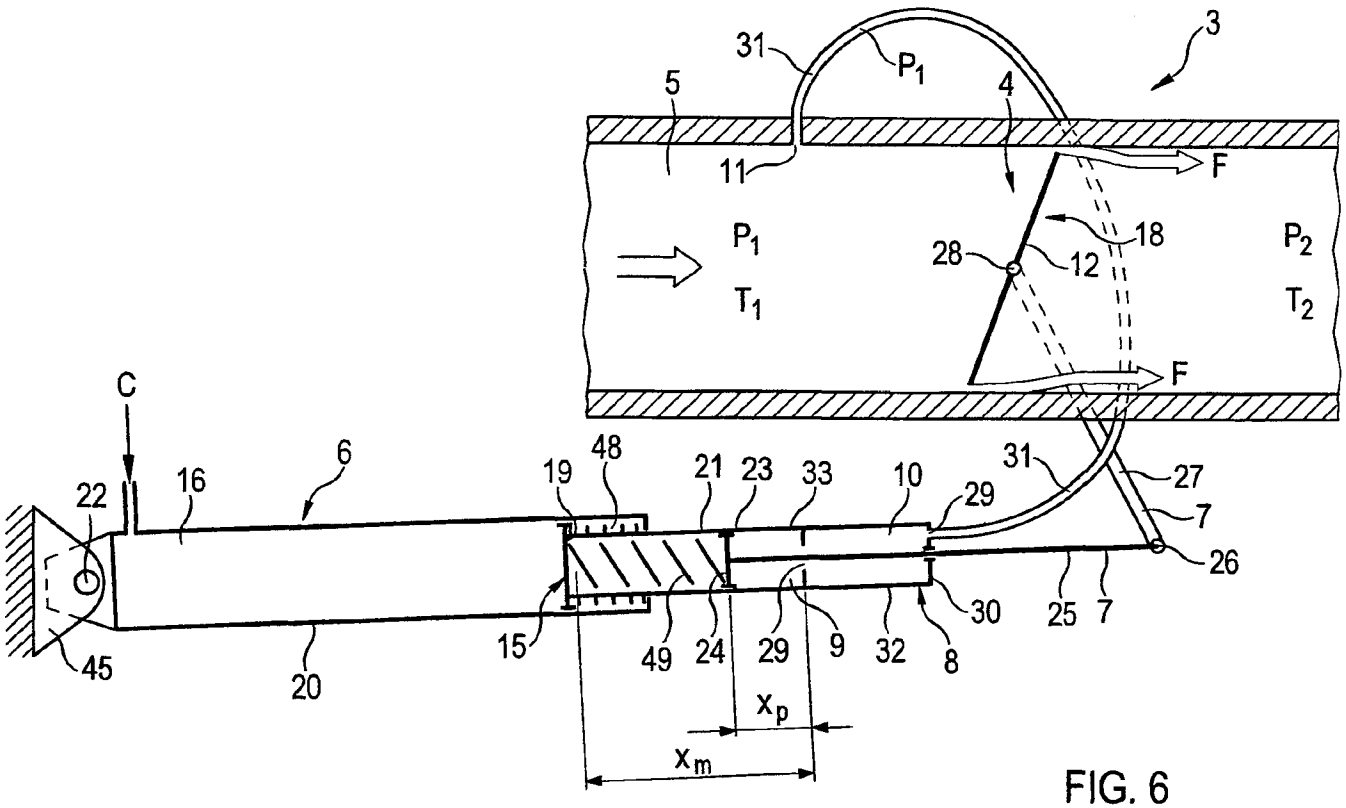
FIG. 6 shows a basic diagram of an exhaust gas control system of a third embodiment of the invention.

FIG. 6 shows a basic diagram of an exhaust gas control system 3 of a third embodiment of the invention in a second end position 15 of the piston 19 of the drive 16 in the operating cylinder 20. Here too, components with the same functions as in the previous figures are denoted by the same reference signs and are not explained specially. The difference with respect to the previous embodiments is that the connecting rod 21 is now replaced by a hollow cylinder 33, in which both the pressure compensation volume 10 and the control actuator 9 are accommodated. This hollow cylinder 33 is fixed directly on the drive piston 19, allowing a significantly greater maximum deflection $x_m$ for the movement of the actuator rod 25. Such an enlargement is advantageous for an exhaust gas control system which is to be used for cleaning a DPF, especially as this cleaning and also the throttling of the exhaust gas in the exhaust gas duct 5 take place with the engine running and injection switched on. For this purpose, the exhaust gas throttle valve 4 is arranged in a zone of the exhaust system downstream of the DPF and upstream of an exhaust muffler (not shown) of an internal combustion engine. This exhaust gas control system 3 can be used for cleaning diesel particle filters on a fixed engine, a marine engine or for diesel drive units of electric generators and rail vehicles.

Figure 7:
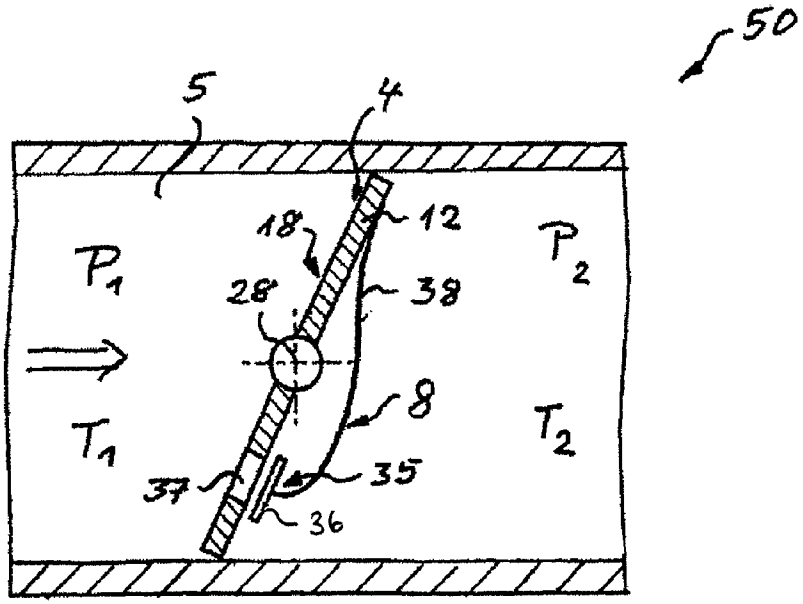
FIG 7 PRIOR ART
FIG. 7 shows a basic diagram of an exhaust gas control system in accordance with the prior art.
Figure 8:
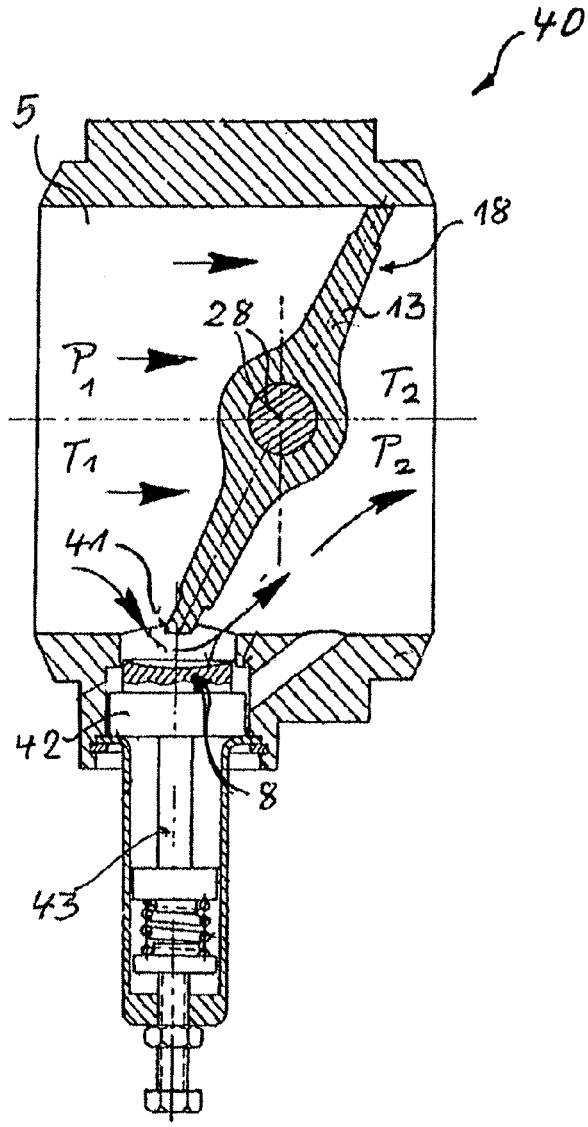
FIG. 8 shows a basic diagram of another exhaust gas control system in accordance with the prior art.
Figure 9:
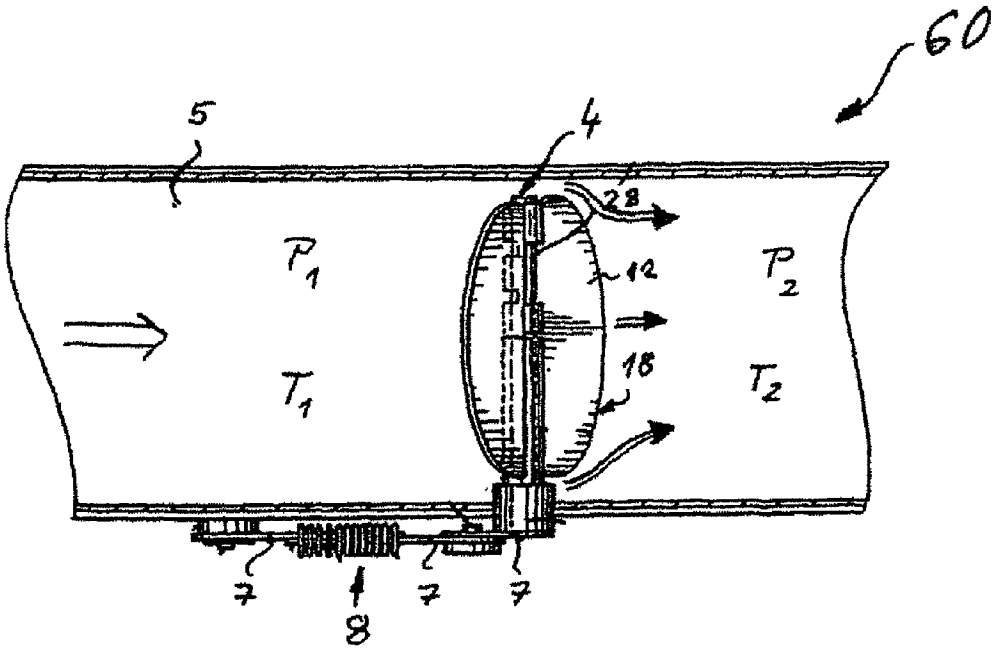
FIG 9 PRIOR ART
FIG. 9 shows a basic diagram of an additional exhaust gas control system in accordance with the prior art.

FIGS. 7 to 9 show prior art embodiments of exhaust gas control systems 40, 50 and 60 and have already been discussed at the outset, thus making it possible to avoid repetition at this point.

TABLE OF REFERENCE NUMERALS

1 exhaust gas control system (first embodiment)
2 exhaust gas control system (second embodiment)
3 exhaust gas control system (third embodiment)
4 exhaust gas throttle valve
5 exhaust gas duct
6 actuation device
7 actuating linkage
8 control device
9 control actuator
10 pressure compensation volume
11 restrictor opening
12 throttle flap
13 butterfly throttle flap
14 first end position of the drive
15 second end position of the drive
16 drive
17 open position
18 pressure-determined controlled stable position
19 piston
20 operating cylinder of the drive
21 connecting rod of the drive
22 pivotally attached end of the operating cylinder
23 actuator cylinder
24 actuator piston
25 actuator rod
26 free end of the actuator rod
27 lever arm of the exhaust gas throttle valve
28 pivot of the exhaust gas throttle valve
29 opening of the actuator cylinder
30 pressure compensation volume container
31 pressure line
32 housing or container
33 hollow cylinder
34 closed position
35 pressure limiting valve
36 valve flap
37 opening
38 leaf spring
39 switch
40 exhaust gas control system (prior art)
41 zone
42 valve head
43 pressure relief valve
44 pressure line
45 fixed point
46 compressed air supply line
47 pressure discharge opening
48 helical spring element
49 helical spring element
50 exhaust gas control system (prior art)
51 stop element
60 exhaust gas control system (prior art)
$P_m$ compensated exhaust gas pressure
$P_1$ exhaust gas pressure (upstream of the valve)
$P_2$ exhaust gas pressure (downstream of the valve)
$T_1$ exhaust gas temperature (upstream of the valve)
$T_2$ exhaust gas temperature (downstream of the valve)
$x_m$ maximum deflection
$x_p$ pressure-dependent deflection
A to G direction of arrows The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An exhaust gas control system for use with an exhaust gas duct, comprising:

an exhaust gas throttle valve arrangeable in the exhaust gas duct;

an actuation device for actuating the exhaust gas throttle valve, said actuation device having an actuating linkage;

an exhaust gas pressure control device for controlling exhaust gas pressure occurring in the exhaust gas duct upstream of the exhaust gas throttle valve; and wherein the actuating linkage includes a control actuator, which interacts with a pressure compensation volume, the pressure compensation volume being connected pneumatically to a restrictor opening upstream of the exhaust gas throttle valve; and wherein the restrictor opening in conjunction with the compensation volume function as a delay element largely filtering high-frequency pressure peaks out of pulsations in the exhaust gas pressure.

2. The exhaust gas control system according to claim 1, wherein the exhaust gas pressure control device includes an exhaust gas pressure limiting device.

3. The exhaust gas control system according to claim 1, wherein the exhaust gas throttle valve includes a throttle flap.

4. The exhaust gas control system according to claim 1, wherein the exhaust gas throttle valve includes a butterfly throttle flap.

5. The exhaust gas control system according to claim 1, wherein the actuation device further comprises:

a drive operatively configured to assume two end positions, a first end position in which the actuating linkage and the control actuator maintain the exhaust gas throttle valve in an open position, and a second end position in which the exhaust gas throttle valve has a position determined by the control actuator and the exhaust gas pressure of the pressure compensation volume.

6. The exhaust gas control system according to claim 5, wherein the drive includes an electromagnetically operated piston.

7. The exhaust gas control system according to claim 5, wherein the drive includes a hydraulically operated piston.

8. The exhaust gas control system according to claim 5, wherein the drive includes a pneumatically operated piston.

9. The exhaust gas control system according to claim 5, wherein the drive includes a piston, the control actuator being operatively coupled mechanically to the piston.

10. The exhaust gas control system according to claim 5, wherein the drive further comprises:

an operating cylinder;

a piston; and a connecting rod, the piston being preloaded in a spring-elastic manner in a first, inactive state of the operating cylinder; and wherein the operating cylinder is fixed in an articulated manner at an end situated opposite the connecting rod.

11. The exhaust gas control system according to claim 1, wherein the control actuator further comprises:

an actuator cylinder;

an actuator piston; and an actuator rod fixed on the actuator piston, the actuator piston being preloaded in a spring-elastic manner; and wherein the actuator rod is pivotally attached at a free end to a lever arm interacting with a pivot of the exhaust gas throttle valve.

12. The exhaust gas control system according to claim 10, wherein the control actuator further comprises:

an actuator cylinder;

an actuator piston; and an actuator rod fixed on the actuator piston, the actuator piston being preloaded in a spring-elastic manner; and wherein the actuator rod is pivotally attached at a free end to a lever arm interacting with a pivot of the exhaust gas throttle valve.

13. The exhaust gas control system according to claim 11, wherein the actuator cylinder comprises an opening connectable pneumatically to the pressure compensation volume; and wherein in a reduced-pressure state of the pressure compensation volume, the lever arm has a maximum deflection and in a pressurized state of the pressure compensation volume, the lever aim has a deflection controlled as a function of pressure.

14. The exhaust gas control system according to claim 12, wherein the actuator cylinder comprises an opening connectable pneumatically to the pressure compensation volume; and wherein in a reduced-pressure state of the pressure compensation volume, the lever arm has a maximum deflection and in a pressurized state of the pressure compensation volume, the lever arm has a deflection controlled as a function of pressure.

15. The exhaust gas control system according to claim 13, wherein the pressure compensation volume is formed by a container arranged at a restrictor opening of the exhaust gas duct, the container being connected to the opening of the actuator cylinder via a pressure line.

16. The exhaust gas control system according to claim 14, wherein the pressure compensation volume is formed by a container arranged at a restrictor opening of the exhaust gas duct, the container being connected to the opening of the actuator cylinder via a pressure line.

17. The exhaust gas control system according to claim 1, wherein the pressure compensation volume and the control actuator are arranged in a common housing.

18. The exhaust gas control system according to claim 10, wherein the connecting rod of the drive is configured as a hollow cylinder, wherein the control actuator is configured as part of the hollow cylinder.

19. The exhaust gas control system according to claim 11, wherein the connecting rod of the drive is configured as a hollow cylinder, wherein the control actuator is configured as part of the hollow cylinder.

20. The exhaust gas control system according to claim 13, wherein the connecting rod of the drive is configured as a hollow cylinder, wherein the control actuator is configured as part of the hollow cylinder.

21. The exhaust gas control system according to claim 10, wherein the connecting rod of the drive is configured as a hollow cylinder, wherein the control actuator and the pressure compensation volume are configured as part of the hollow cylinder.

22. The exhaust gas control system according to claim 1, wherein the exhaust gas throttle valve is operatively arranged downstream of an exhaust manifold of an internal combustion engine and upstream of a soot particle filter.

23. The exhaust gas control system according to claim 1, wherein the exhaust gas throttle valve is arranged downstream of a soot particle filter of an internal combustion engine and upstream of an exhaust muffler.

24. A method of controlling exhaust gas via an exhaust gas control system including an exhaust gas throttle valve arranged in an exhaust gas duct, an actuation device operatively configured for the exhaust gas throttle valve and including an actuating linkage, and an exhaust gas pressure control device for controlling pulsating exhaust gas pressures occurring in the exhaust gas duct upstream of the exhaust gas throttle valve, the method comprising the acts of:

feeding a pulsating exhaust gas pressure from a restrictor opening provided upstream of the exhaust gas throttle valve to a pressure compensation volume;

filtering high-frequency pressure peaks out of the pulsating exhaust gas pressure via the restrictor opening operating in conjunction with the compensation volume to function as a delay element;

feeding the filtered exhaust gas pressure to a control actuator;

holding the exhaust gas throttle valve stably in an open position by way of the actuating linkage having the control actuator when in a first end position of a drive; and holding the exhaust gas throttle valve in a stable position controlled by applied pressure of the compensated exhaust gas pressure fed to the control actuator by way of the actuating linkage when in a second end position of the drive.

25. The method according to claim 24, wherein in a closed position of the exhaust gas throttle valve, the method further comprises the act of:

opening an exhaust gas throttle flap of the exhaust gas throttle valve in a controlled manner as a function of the compensated exhaust gas pressure.

26. The method according to claim 24, wherein the restrictor opening and the pressure compensation volume form a delay element having a filter effect in which pressure peaks in the pulsating exhaust gas pressure are filtered, said filtering being configured such that the exhaust gas throttle flap assumes a stable position controlled as a function of pressure.

27. The method according to claim 24, wherein the exhaust gas throttle valve is held in a first open position as long as the drive of the actuation device is inactive and maintains the first end position.

28. The method according to claim 27, wherein as soon as the drive of the actuation device is activated and assumes the second end position, the exhaust gas throttle valve is held in a second controlled stable position, wherein in the second end position, the control actuator assumes a setting controlled by the pressure of the pressure compensation volume and accordingly transfers the exhaust gas throttle valve from a closed position to the pressure-dependent second controlled stable position.

29. The method according to claim 27, wherein the drive is operatively configured to drive a piston in an operating cylinder from the first end position to the second end position in one of an electromagnetic, hydraulic and pneumatic manner.

30. The method according to claim 24, wherein a lever arm, which interacts with a pivot of the exhaust gas throttle valve and is pivotally attached to a free end of an actuator rod, is moved as a function of pressure by an actuator piston of an actuator cylinder.

31. The method according to claim 30, wherein the actuator cylinder is connected pneumatically to the pressure compensation volume via an opening and, in a reduced-pressure state of the pressure compensation volume, the lever arm, which is pivotally attached to the actuator rod, assumes a maximum deflection and, in a pressurized state of the pressure compensation volume, the lever arm has imparted to it by the control actuator a deflection controlled as a function of pressure.

32. The method according to claim 24, wherein the exhaust gas throttle valve is arranged downstream of an exhaust manifold of an internal combustion engine and upstream of a soot particle filter of an engine braking system, and wherein the pressure in the exhaust manifold is controlled by the exhaust gas throttle valve such that a maximum permissible pressure in the internal combustion engine and a pressure-dependent maximum permissible temperature are not exceeded during an engine braking process with fuel injection switched off.

33. The method according to claim 24, wherein the exhaust gas throttle valve is arranged downstream of a soot particle filter of an internal combustion engine and upstream of an exhaust muffler of a soot particle filter cleaning system, and wherein the pressure in the exhaust gas duct is controlled by the exhaust gas throttle valve such that a maximum permissible pressure in the internal combustion engine is not exceeded and such that, with fuel injection switched on, a pressure-dependent maximum permissible temperature in the soot particle filter is not exceeded during the cleaning of the soot particle filter.

* * * * *